US009816224B2

(12) United States Patent
Chua et al.

(10) Patent No.: US 9,816,224 B2
(45) Date of Patent: Nov. 14, 2017

(54) GARMENT STEAMER WITH INCLINABLE IRONING BOARD

(71) Applicant: KONINKLIJKE PHILIPS N.V., Eindhoven (NL)

(72) Inventors: Hee Keng Chua, Eindhoven (NL); Yong Jiang, Eindhoven (NL); Zhen Ming Jimmy Xing, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/311,878

(22) PCT Filed: Jan. 8, 2016

(86) PCT No.: PCT/EP2016/050243
§ 371 (c)(1),
(2) Date: Nov. 17, 2016

(87) PCT Pub. No.: WO2016/116298
PCT Pub. Date: Jul. 28, 2016

(65) Prior Publication Data

US 2017/0081798 A1 Mar. 23, 2017

(30) Foreign Application Priority Data

Jan. 23, 2015 (EP) ..... 15152230

(51) Int. Cl.
*D06F 81/00* (2006.01)
*D06F 81/02* (2006.01)
(Continued)

(52) U.S. Cl.
CPC ..... *D06F 81/00* (2013.01); *D06F 73/00* (2013.01); *D06F 81/02* (2013.01); *D06F 81/08* (2013.01); *D06F 87/00* (2013.01)

(58) Field of Classification Search
CPC .. D05C 1/02; D05C 1/04; D06F 81/02; D06F 81/04; D06F 81/00; D06F 81/08;
(Continued)

(56) References Cited

U.S. PATENT DOCUMENTS 1,956,546 A * 4/1934 Froelich ..... A47B 27/08 108/136
3,012,363 A * 12/1961 Sautereau ..... A47B 27/14 108/2
(Continued)

FOREIGN PATENT DOCUMENTS

EP 2586908 A1 5/2013
JP 1952006460 7/1927
(Continued)

*Primary Examiner* — Ismael Izaguirre

(57) ABSTRACT

A garment steamer with an inclinable ironing board (100) comprises a base (10) and a support structure (50) that includes an upper part (51), a lower part (52) and an ironing board (60) attached to the upper part. The garment steamer further comprises an inclining structure (70) including an inclining linkage (80) that connects the upper and lower parts, wherein the upper part (51) is inclinable relative to the lower part (52) at an angle between horizontal and vertical. The inclining linkage (80) comprises first and second link arms (83,84) extending between and pivotably connecting with the upper and lower parts. The first link arm (83) is longer than the second link arm (84) such that upper part (51) assumes an inclined position relative to the lower part (52) when the upper and lower ends of the link arms (83,84) are pivoted about the upper and lower parts (51,52), respectively.

20 Claims, 5 Drawing Sheets

(51) Int. Cl.
*D06F 81/08* (2006.01)
*D06F 73/00* (2006.01)
*D06F 87/00* (2006.01)

(58) Field of Classification Search
CPC ..... D06F 73/00; D06F 87/00; F16M 11/24; F16M 11/10; A47B 3/002; A47B 3/08; A47B 13/023; A47B 2200/0013; A47B 2200/0017; A47B 2200/0022; A47B 2200/0023; A47B 2200/0025; A47B 2200/0055; A47B 2200/0043
See application file for complete search history.

(56) References Cited

U.S. PATENT DOCUMENTS 3,288,090 A * 11/1966 King ..... D06F 81/04 108/138
3,396,928 A * 8/1968 Lay ..... A47B 3/0815 108/129
3,641,946 A * 2/1972 Charnay ..... A47B 27/00 108/6
3,703,147 A * 11/1972 Selander ..... A47B 27/18 108/10
5,119,572 A * 6/1992 Graham ..... D05C 1/02 108/6
5,410,971 A * 5/1995 Golden ..... A47B 17/02 108/1
5,771,613 A * 6/1998 Geils ..... D05C 1/02 108/150
7,757,618 B2 * 7/2010 Chang ..... A47B 9/00 108/145
2002/0195911 A1 12/2002 Allen
2005/0005481 A1 1/2005 Muljadi
2010/0009556 A1 1/2010 Liao
2010/0095565 A1 * 4/2010 Ma ..... D06F 81/08 38/103

FOREIGN PATENT DOCUMENTS

JP 1956009907 6/1931
JP 19644020260 7/1939
JP 1972043213 11/1972

* cited by examiner

GARMENT STEAMER WITH INCLINABLE IRONING BOARD

This application is the U.S. National Phase application under 35 U.S.C. §371 of International Application No. PCT/EP2016/050243, filed on Jan. 8, 2016, which claims the benefit of International Application No. 15152230.7 filed on Jan. 23, 2015. These applications are hereby incorporated by reference herein.

FIELD OF THE INVENTION

The invention relates to garment steamers, particularly, relates to garment steamers with inclinable ironing board.

BACKGROUND OF THE INVENTION

Conventional garment steamer offers a convenient way of removing wrinkles. However when compared to conventional ironing method, the level of wrinkle removal performance is much lower since there is nothing to support the hanged garment. Tough wrinkles cannot be pressed out like in the process of conventional ironing method which uses a horizontal board to support the garment.

Referring to FIG. 1, a garment steamer 200 is introduced trying to solve the above problem. The stand garment steamer 200 comprises a fixed vertical ironing board 210 for steaming. However, such vertical ironing board 210 is not ergonomic and difficult to use, users have to operate in vertical direction, which is not comfortable. Furthermore, such vertical ironing board 210 is very unstable, when exerting force onto the ironing board 210, it tends to fall over. Therefore, this type of garment steamer cannot really support any significant pressing force for removing wrinkles.

An ironing board for multifunctional use is known from US 2010/0095565. This document discloses an ironing board having a base and a body with a work surface which is connected to the base by a column. The column has a tilting means for tilting the body about a tilting axis which extends perpendicularly to the column.

OBJECT AND SUMMARY OF THE INVENTION

It is an object of the invention to propose a stable and compact garment steamer with inclinable ironing board which can be inclined relative to its support structure.

The invention is defined by the independent claims. The dependent claims define advantageous embodiments.

According to the present invention, a garment steamer with inclinable ironing board is provided, the garment steamer comprises a base and a support structure extending upwardly from the base, the support structure comprises an upper part and a lower part, an ironing board is attached to the upper part, an inclining structure comprising an inclining linkage that connects the upper part and the lower part in such a way that the upper part is inclinable relative to the lower part and can be fixed in a position in which the upper part is inclined from the lower part at an angle between horizontal and vertical, wherein the inclining linkage comprises first and second link arms extending side-by-side between the upper and lower parts of the support structure, each of the first and second link arms having an upper end pivotably connected to the upper part and a lower end pivotably connected to the lower part, the first link arm being longer than the second link arm such that upper part assumes an inclined position relative to the lower part when the upper and lower ends of the link arms are pivoted about the upper and lower parts, respectively, of the support structure.

Preferably, the incline angle is between 15 to 45 degrees relative to vertical direction, and a support structure extends upwardly from both sides of the base. The inclining structure may be part of the support structure.

According to a first embodiment of the present invention, the first inclining linkage comprises a top link rigidly connected to the upper part of the support structure; a bottom link rigidly connected to the lower part of the support structure; wherein the upper ends of the first and second link arms are pivotably connected to the top link and the lower ends of the first and second link arms are pivotally connected to the bottom link.

In a preferred embodiment, the garment steamer comprises a sleeve mounted to the support structure and slidable between a first position in which it encloses the first and second link arms to hold the first and second link arms in a first position in which the upper and lower ends of the link arms are free to pivot about the upper and lower parts, respectively, of the support structure. The incline angle may be determined by the difference in length of the first and second link arms. Preferably, the top link is part of the upper part of the support structure, and the bottom link is part of the lower part of the support structure.

According to a second embodiment of the present invention, there is provided a garment steamer with inclinable ironing board comprising a base, a support structures extending upwardly from the base, the support structure comprising an upper part and a lower part, an ironing board attached to the upper part, an inclining structure, comprising an inclining linkage, connecting the upper part and the lower part in such a way that the upper part is inclinable relative to the lower part and can be fixed in a position in which the upper part is inclined from the lower part at an angle between horizontal and vertical, wherein the inclining linkage comprises: an upper link pivotably connected to an lower link, the lower link comprising a rounded end and a plurality of recesses radially defined in the rounded end; and a spring loaded plunger arranged inside the upper link, and biased against the rounded end of the lower link such that when the plunger is aligned to one of the recesses, it locates in said recess to lock the upper link in an inclined position relative to the lower link.

The upper link may be integral with, or rigidly connected to, the upper part of the support structure. The lower link may be integral with, or rigidly connected to, the lower part of the support structure.

The incline angle may be determined by the angle between the recess and the vertical direction. In one embodiment, a spring housing is secured inside the upper link, the plunger extends through the spring housing, a spring is housed in the spring housing and arranged between an inner face of the spring housing and a shoulder on the plunger in order to exert a spring force on the plunger.

By the inclining structure of the present invention, the ironing board of the garment steamer can be inclined relative to the lower part of the support structure so that users can operate the steamer comfortably. The incline angle can be fixed by employing the first inclining linkage, and alternatively the incline angle can be adjustable by employing the second inclining linkage. The support structure of the garment steamer with inclinable ironing board can be implemented as a pair of support poles which extends upwardly from both sides of the base, which enable the steamer to stand stably when force is exerted on the ironing board. A selected sized board can also strengthen the stability of the steamer. The support structure is preferably implemented as retractable structure, when not in used, the inclining structure together with the support structure can be retracted in order to save storage space.

Detailed explanations and other aspects of the invention will be given below.

BRIEF DESCRIPTION OF THE DRAWINGS

Particular aspects of the invention will now be explained with reference to the embodiments described hereinafter and considered in connection with the accompanying drawings, in which identical parts or sub-steps are designated in the same manner.

DETAILED DESCRIPTION OF THE INVENTION

To make users feel comfortable when operating the garment steamer, its ironing board need to be ergonomic, which required the ironing board can be inclined to a certain angle.

Figure 1:
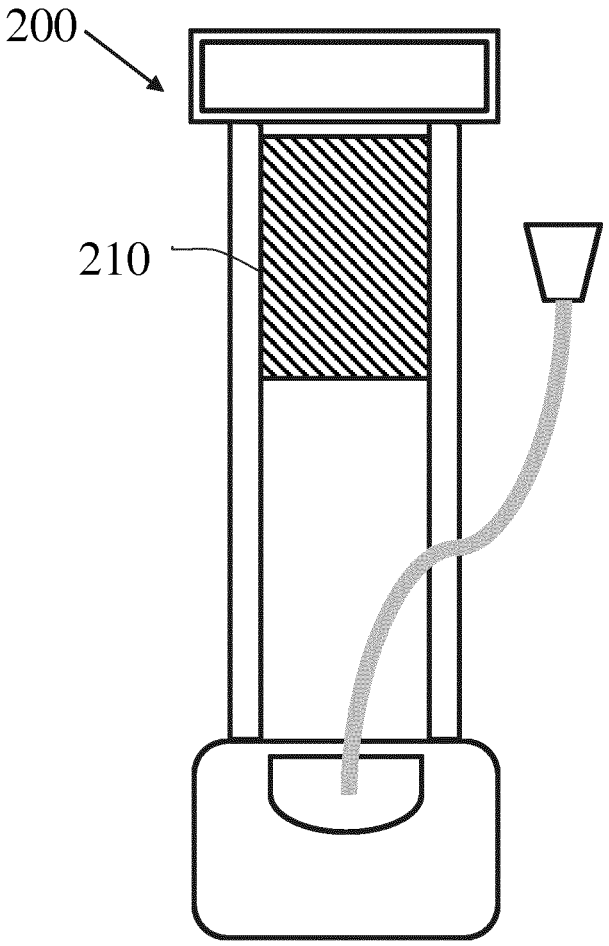
FIG. 1 shows a garment steamer with fixed vertical ironing board that is known from a prior art.
Figure 2:
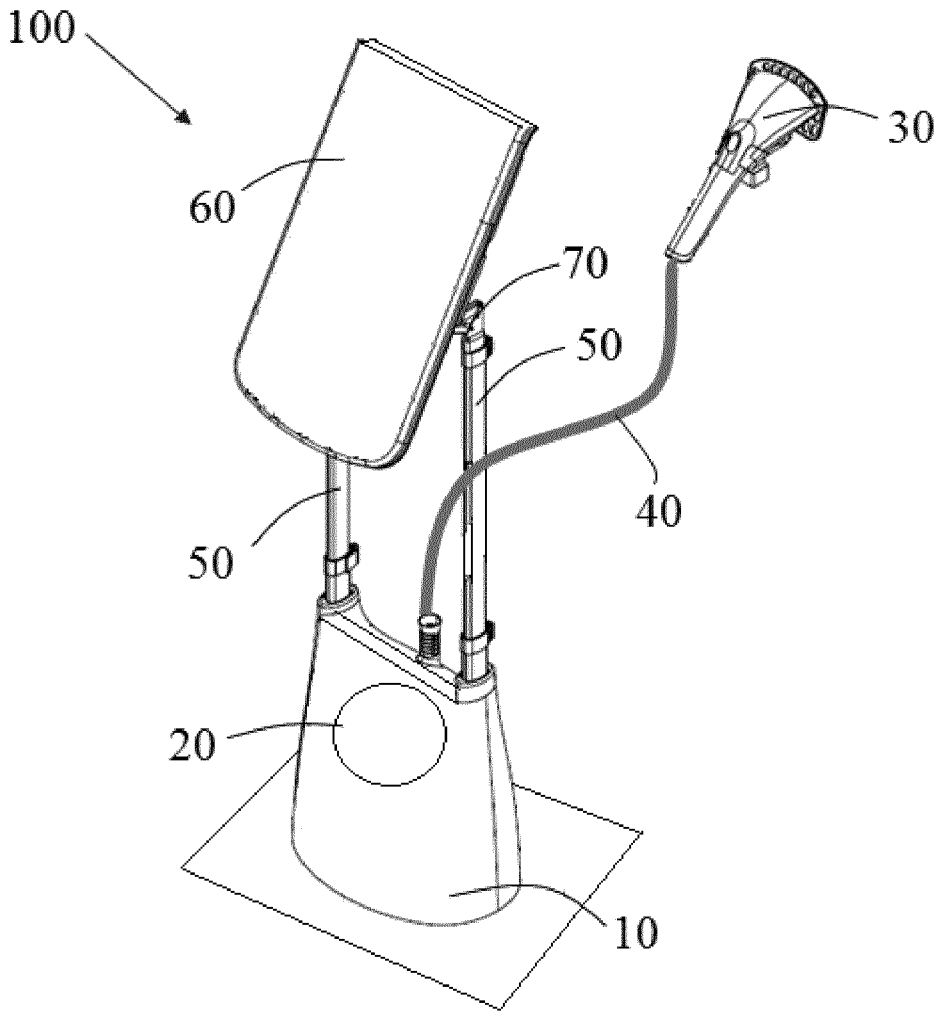
FIG. 2 shows a garment steamer with inclinable ironing board with ironing board which can be inclined via an inclining structure according to the present invention.

Referring to FIG. 2, the present invention proposes a garment steamer with inclinable ironing board to meet the above requirement. The garment steamer with inclinable ironing board 100 comprises a base 10. A steam generator 20 is attached to or separately positioned from the base 10. A steamer head 30 is connected to the steam generator 20 by a steam hose 40. A support structure 50 extends upwardly from the base 10, the support structure 50 can be a pole. In a preferred embodiment, there are two poles extends upwardly from both sides of the base 10, and the poles are preferably retractable which can be retracted when they are not in use in order to make the garment steamer compact. It is understandable that the number of the pole and the position of the pole can be varied depend on its size, the requirement of stability, and other consideration.

The support structure 50 has an upper part 51 and a lower part 52. The upper part 51 and lower part 52 are connected via an inclining structure 70. In a preferred embodiment of the invention, the inclining structure 70 is part of the support structure 50. In an alternatively embodiment of the invention, the inclining structure 70 is separate component which is attached upper part 51 and lower part 52 of the support structure 50.

In a preferred embodiment of the invention, the ironing board 60 is attached to the upper part 52 of the support structure 50. Therefore the ironing board 60 moves together with the upper part 52. The inclining structure 70 is connected to the support structure 50 such that the upper part 51 of the support structure 50 is inclined relative to the lower part 52 of support structure 50 and can be fixed in a position in which the upper part 51 is inclined from the lower part 52 at an angle between horizontal and vertical. As a result of being attached to and moving together with the upper part 51 of the support structure 50, the ironing board 60 is therefore inclined from the lower part 52 of the support structure 50 at an angle between horizontal and vertical. The ironing board 60 can be a full board, or for compact consideration, a half board or a board with a size within the footprint of the base 10.

Figure 3:
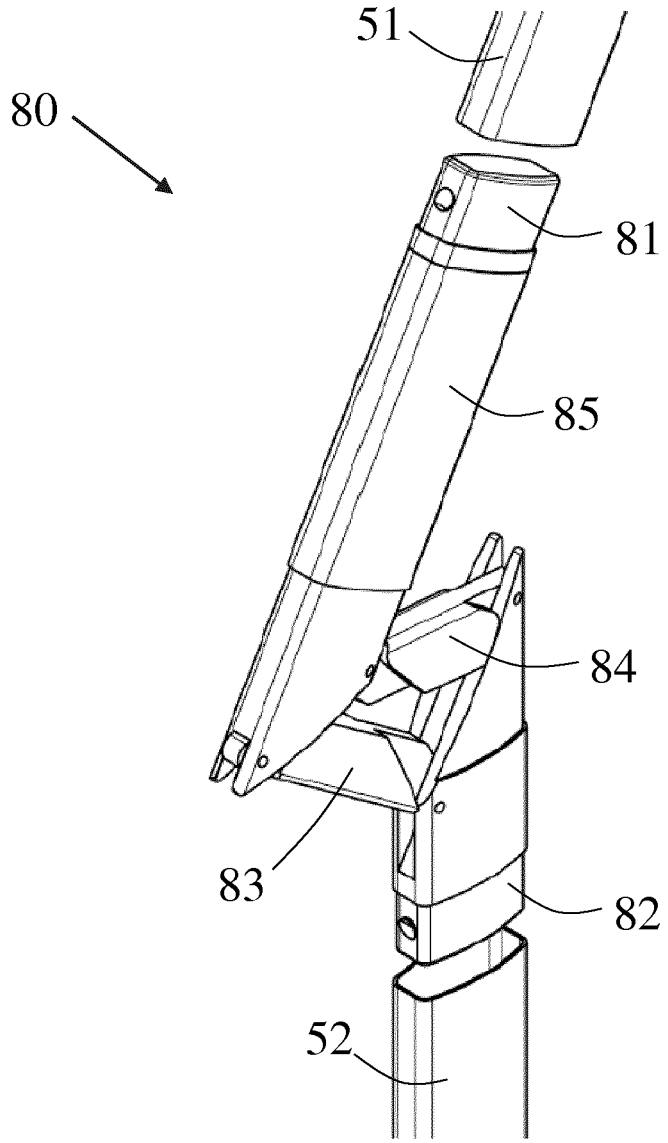
FIG. 3 shows a first embodiment of the inclining structure of the present invention.

FIG. 3 shows a first embodiment of the inclining structure 70, which is described here as a first inclining linkage 80.

The first inclining linkage 80 comprises a top link 81, a bottom link 82, a front link 83, a rear link 84, and a sleeve 85. The upper part 51 of the support structure 50 is rigidly connected to the top link 81. The lower part 52 of the structure 50 is rigidly connected to the bottom link 82. In a preferred embodiment, the top link 81 is part of the upper part 51 of the support structure 50, and the bottom link 52 is part of the lower part 52 of the support structure 50. In an alternative embodiment, the top link 81 and bottom link 82 are separate components which are rigidly connected respectively to the upper part 51 and lower part 52.

The front link 83 and rear link 84 are, respectively, pivotably connected to a lower end of the top link 81 and an upper end of the bottom link 82. There is a height difference between the ends of the front link 83 and rear link 84 at where they connect the top link 81 or the bottom link 82. Therefore, when pivoting, the front link 83 and the rear link 84 form a step which defines an incline angle between the top link 81 and bottom link 82 which connect to the front link 83 and rear link 84 respectively. Since the upper part 51 of the support structure 50 is rigidly connected to the top link 81, and the lower part 52 of the support structure 50 is rigidly connected to the bottom link 82, the upper part 51 of the support structure 50 is therefore inclined from the lower part 52 of the support structure 50 at a predetermined incline angle defined by said height difference. Furtherly, the ironing board 60 attached to the upper part 51 of the support structure 50 moves together with the upper part 51 and is therefore inclined from the lower part 52 of the support structure 50 at a predetermined incline angle defined by said height difference. By varying the height difference, the incline angle can be varied between horizontal and vertical. A comfortable incline angle for users' steaming operation is commonly from 15 to 45 degrees, preferably 30 degrees.

The sleeve 85 is arranged slidably enclosing the top link 81, bottom link 82, front link 83 and rear link 84 in a vertical position. The overall outside dimension of the top link 81, bottom link 82, front link 83 and rear link 84, when in a vertical position, is smaller than the inner opening of the sleeve 85. This allows the sleeve 85 to slide up or down along the top link 81, bottom link 82, front link 83 and rear link 84. When the sleeve 85 slides to a first position where it encloses the front link 83 and rear link 84, the front link 83 and rear link 84 are held substantially in a vertical position without pivoting; when the sleeve 85 slides to a second position where it does not enclose the front link 83 and rear link 84, that is, the front link 83 and rear link 84 are exposed from the sleeve 85, the front link 83 and rear link 84 pivot relative to the top link 81 and bottom link 82 so that a step is formed which leads to incline angle between the top link 81 and bottom link 82, and therefore between the upper part 51 and lower part 52 of the support structure, and further between the ironing board 60 and the lower part 52 of the support structure 50.

Preferably, the overall outside size and profile of the sleeve 85 are the same as the support structure 50, therefore, in the case of the support structure 50 is implemented as retractable pole, it enables the whole first inclining linkage 80 to be refracted together with the retractable pole for a compact storage purpose.

Figures 4A, 4B, 4C:
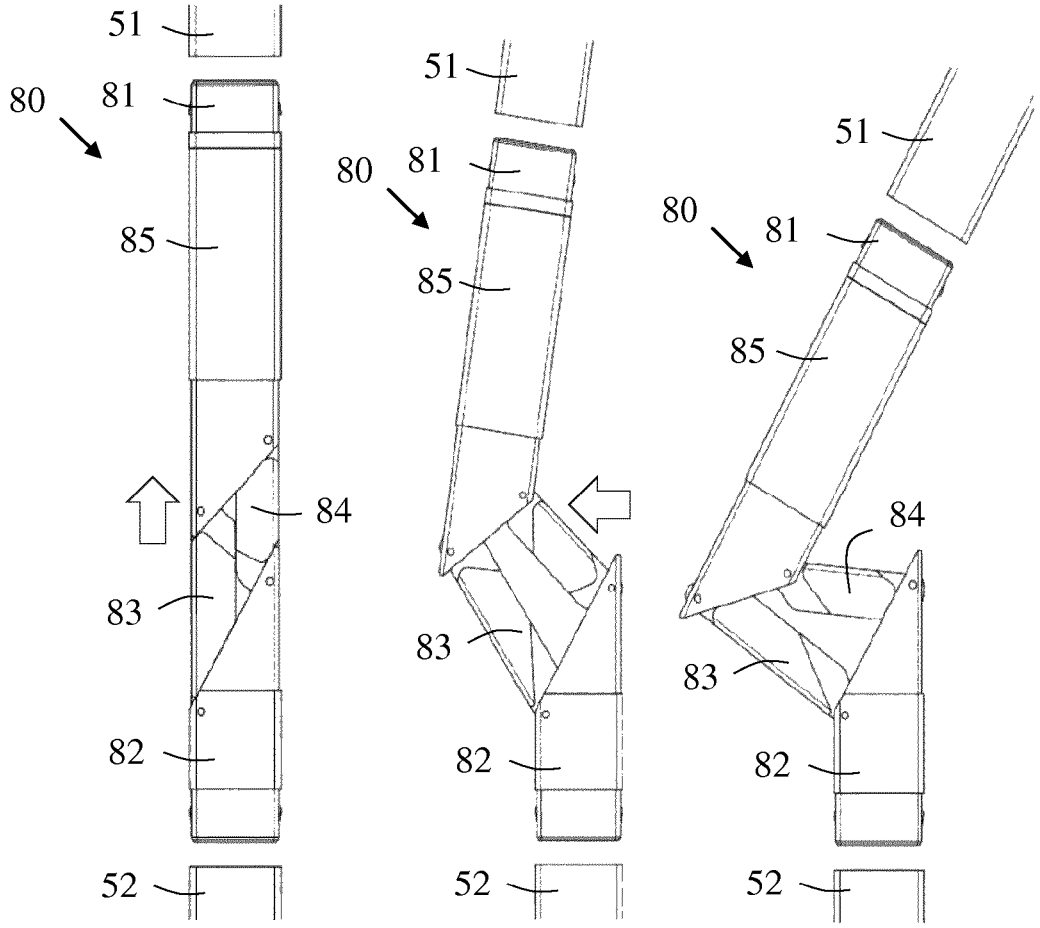
FIG. 4A to 4C show the inclining process of the first inclining linkage shown in FIG. 3.

FIG. 4A to 4C show the inclining process of the first inclining linkage 80. Referring to FIG. 4A, the sleeve 85 is initially in the first position where it encloses the front link 83 and rear link 84, in this case, the front link 83 and rear link 84 are held inside the sleeve 85 and cannot pivot, the first inclining linkage 80 is therefore locked in a vertical position. To release the first inclining linkage 80, the sleeve 85 slides upwardly to the second position where it clears both the front link 82 and rear link 83. Referring to FIG. 4B, at the second position, the sleeve 85 is slightly pulled towards the front link 83 in order to break the straight line of the first inclining linkage 80. After which, due to gravity, the weight of the top link 81, sleeve 85, upper part 51 of the support structure 50, and ironing board 60 will actuate the front link 83 and rear link 84 to pivot relative to the top link 81 and bottom link 82. Referring to FIG. 4C, when the pivoting stops, a step is formed between the front link 83 and the rear link 84, the top link 81 is therefore inclined to an angle relative to the bottom link 82.

To reset the first inclining linkage 80, the top link 81 is lifted up to a vertical position. Due to the connection between the top link 81 and the front link 83 and rear link 84, the front link 83 and rear link 84 are pulled up to a vertical position. Due to gravity, the sleeve 85 drops down to a position where it encloses and holds the front link 83 and rear link 84 so as to lock the top link 81 and bottom link 82 in a vertical position without inclining.

Figure 5A:
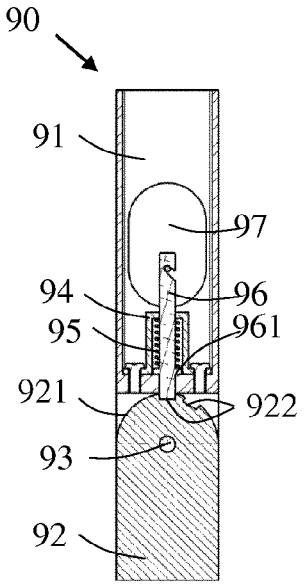
FIG. 5A to 5C show a second embodiment of the inclining structure of the present invention.
Figure 5B:
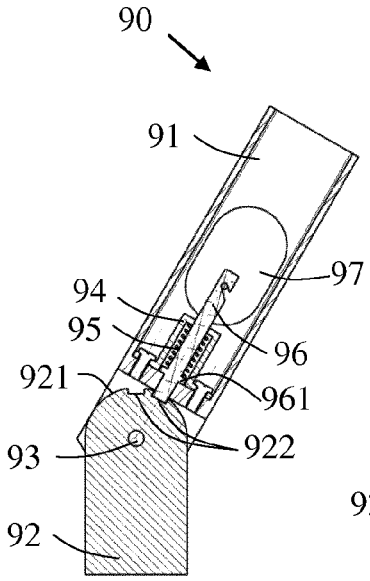
Figure 5C:
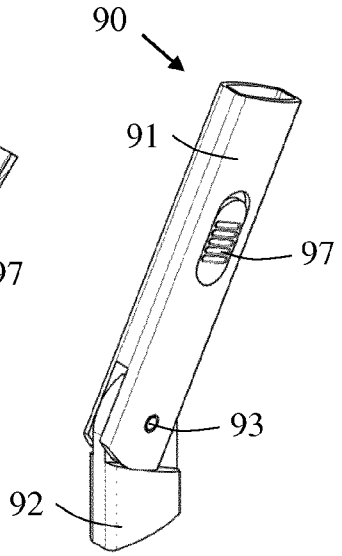

FIG. 5A to 5C shows a second embodiment of the inclining structure 70, which is described here as a second inclining linkage 90. The first and second inclining linkages (80,90) may be used together or, they may be used independently.

The second inclining linkage 90 comprises an upper link 91 and a lower link 92, the upper link 91 is pivotably connected to the lower link 92 via a pivot 93. The upper part 51 of the support structure 50 is rigidly connected to the upper link 91, and the lower part 52 is rigidly connected the lower link 92. In a preferred embodiment, the upper link 91 is part of the upper part 51 of the support structure 50, and the lower link 92 is part of the lower part 52 of the support structure 50. In an alternative embodiment, the upper link 91 and lower link 92 are separate components which are respectively rigidly connected to the upper part 51 and lower part 52 of the support structure 50.

The lower link 92 comprises a rounded end 921 which faces the upper link 91 when the lower link 92 is connected to the upper link 91. A plurality of recesses 922 are radially defined in the rounded end 921. Inside the upper link 91, a spring housing 94 is secured at a bottom of the upper link 91. A plunger 96 extends through the spring housing 94, one end of the plunger 96 is fixed to a release button 97 arranged on a surface of the upper link 91, the other end of the plunger 96 rides along the rounded end 921 of the lower link 92. The plunger 96 comprises a shoulder 961. A spring 95 is housed in the spring housing 94, one end abuts against an inner face of the spring housing 94, and the other end abuts against the shoulder 961 of the plunger 96.

When the upper link 91 pivots relative to the lower link 92, the plunger 96 rides along the rounded end 921 of the lower link 92, when the plunger 96 is aligned to one of the recesses 922, the plunger 96 is pushed by the spring 95 to plug into the recess 922. In this case, the upper link 91 is locked in a position where it is inclined relative to the lower link 92 at an incline angle. Since the upper part 51 of the support structure 50 is rigidly connected to the upper link 91, and the lower part 52 of the support structure 50 is rigidly connected to the lower link 92, the upper part 51 of the support structure 50 is therefore inclined from the lower part 52 of the support structure 50 at an incline angle defined by the angle between the recess 922 and vertical direction. Furtherly, the ironing board 60 attached to the upper part 51 of the support structure 50 moves together with the upper part 51 and is therefore inclined from the lower part 52 of the support structure 50 at an angle defined by the angle between the recess 922 and vertical direction. The incline angle can be adjusted by aligning the plunger 96 to different recesses 922. To reset the upper link 91 and lower link 92 to vertical position, the release button 97 is pushed upward, the spring 95 is therefore compressed, and the plunger 96 is released from the recess 922. Preferably, a recess 922 is defined in a vertical direction so that when the upper link 91 and lower link 92 is reset to the vertical position, they can be locked by the plunger 96 plugging into this recess 922.

The width of the ironing board 50 of the present invention is preferably equal to the width of a hanger of the garment steamer with inclinable ironing board 100. The length of the ironing board 50 is preferably shorter than or equal to the length of a typical top garment, for example a shirt.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the spirit and scope of the technique approaches of the present invention, which will also fall into the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A garment steamer with inclinable ironing board comprising:

a base;

a support structure extending upwardly from the base, wherein the support structure comprises an upper part, a lower part, and an ironing board attached to the upper part; and an inclining structure, wherein the inclining structure comprises an inclining linkage that connects the upper part and the lower part in such a way that the upper part is inclinable relative to the lower part and can be fixed in a position in which the upper part is inclined from the lower part at an angle between horizontal and vertical, wherein the inclining linkage comprises front and rear link arms extending between and pivotably connecting with the upper and lower parts of the support structure, the front and rear link arms each having an upper end pivotably connected to the upper part and a lower end pivotably connected to the lower part, the front link arm having a length, as measured between the upper end and the lower end of the front link arm, that is longer than a length, as measured between the upper end and the lower end, of the rear link arm such that upper part assumes an inclined position relative to the lower part in response to the upper and lower ends, respectively, of both the front and rear link arms pivoting about the upper and lower parts, respectively, of the support structure.

2. The garment steamer with inclinable ironing board according to claim 1, wherein the incline angle is between 15 to 45 degrees relative to a vertical direction.

3. The garment steamer with inclinable ironing board according to claim 1, further comprising a support structure extending upwardly from both sides of the base.

4. The garment steamer with inclinable ironing board according to claim 1, wherein the inclining structure is part of the support structure.

5. A garment steamer with inclinable ironing board comprising a base, a support structure extending upwardly from the base, and an inclining structure, wherein the support structure comprises an upper part, a lower part, and an ironing board attached to the upper part, wherein the inclining structure comprises an inclining linkage that connects the upper part and the lower part in such a way that the upper part is inclinable relative to the lower part and can be fixed in a position in which the upper part is inclined from the lower part at an angle between horizontal and vertical, wherein the inclining linkage comprises front and rear link arms extending between the upper and lower parts of the support structure, the front and rear link arms each having an upper end pivotably connected to the upper part and a lower end pivotably connected to the lower part, the front link arm being longer than the rear link arm such that upper part assumes an inclined position relative to the lower part when the upper and lower ends of the front and rear link arms are pivoted about the upper and lower parts, respectively, of the support structure, wherein said inclining linkage further comprises:

a top link rigidly connected to the upper part of the support structure;

a bottom link rigidly connected to the lower part of the support structure;

wherein the upper ends of the front and rear link arms are pivotably connected to the top link and the lower ends of the front and rear link arms are pivotally connected to the bottom link.

6. The garment steamer with inclinable ironing board according to claim 5, further comprising a sleeve mounted to the support structure and slidable between a first position in which it encloses the front and rear link arms to hold the front and rear link arms in a first position in which the upper part is not inclined relative to the lower part and, a second position in which the upper and lower ends of the front and rear link arms are free to pivot about the upper and lower parts, respectively, of the support structure.

7. The garment steamer with inclinable ironing board according to claim 6, wherein the incline angle is determined by the difference in length of the front and rear link arms.

8. The garment steamer with inclinable ironing board according to claim 6, wherein the top link is part of the upper part of the support structure.

9. The garment steamer with inclinable ironing board according to claim 6, wherein the bottom link is part of the lower part of the support structure.

10. The garment steamer with inclinable ironing board according to claim 5, the incline angle is between 15 to 45 degrees relative to vertical direction.

11. The garment steamer with inclinable ironing board according to claim 5, comprising a support structure extending upwardly from both sides of the base.

12. The garment steamer with inclinable ironing board according to claim 5, wherein the inclining structure is part of the support structure.

13. A garment steamer with inclinable ironing board comprising:

a base;

a support structure extending upwardly from the base, the support structure comprising an upper part and a lower part;

an ironing board attached to the upper part; and an inclining structure, wherein the inclining structure comprises an inclining linkage configured to connect the upper part and the lower part, wherein the upper part is inclinable relative to the lower part and can be fixed in a position in which the upper part is inclined from the lower part at an angle between horizontal and vertical, wherein the inclining linkage comprises:

an upper link pivotably connected to a lower link, wherein the lower link comprises a rounded end and a plurality of recesses radially defined in the rounded end, and a spring loaded plunger having a spring and being arranged inside the upper link, wherein a first end of the spring loaded plunger is biased against the rounded end of the lower link, and wherein responsive to the first end of the spring loaded plunger being aligned to one of the recesses, the first end of the spring loaded plunger locates in the aligned recess, via an expansion of the spring, to lock the upper link in an inclined position relative to the lower link, and wherein responsive to a compression of the spring via an upward force applied, via a release button, at a second end of the spring loaded plunger, the first end of the spring loaded plunger is released from the aligned recess.

14. The garment steamer according to claim 13, wherein the upper link is integral with, or rigidly connected to, the upper part of the support structure.

15. The garment steamer according to claim 13, wherein the lower link is integral with, or rigidly connected to, the lower part of the support structure.

16. The garment steamer with inclinable ironing board according to claim 13, wherein the incline angle is determined by the angle between the recess and the vertical direction.

17. The garment steamer with inclinable ironing board according to claim 13, wherein a spring housing is secured inside the upper link, the plunger extends through the spring housing, and a spring is housed in the spring housing and arranged between an inner face of the spring housing and a shoulder on the plunger in order to exert a spring force on the plunger.

18. A garment steamer with inclinable ironing board comprising:

a base;

a support structure extending upwardly from the base, wherein the support structure comprises an upper part and a lower part;

an ironing board attached to the upper part; and an inclining structure, wherein the inclining structure comprises an inclining linkage that connects the upper part and the lower part in such a way that the upper part is inclinable relative to the lower part and can be fixed in a position in which the upper part is inclined from the lower part at an angle between horizontal and vertical, wherein the inclining linkage comprises:

an upper link pivotably connected to a lower link, wherein the lower link comprises a rounded end and a plurality of recesses radially defined in the rounded end, and a spring loaded plunger arranged inside the upper link, and biased against the rounded end of the lower link such that when the plunger is aligned to one of the recesses, it locates in said recess to lock the upper link in an inclined position relative to the lower link, wherein an end of the plunger inside the upper link is connected to a release button, the release button being operable to release the plunger from a recess.

19. The garment steamer according to claim 18, wherein the upper and lower links comprise at least one selected from the group consisting of (i) the upper link is integral with, or rigidly connected to, the upper part of the support structure, (ii) the lower link is integral with, or rigidly connected to, the lower part of the support structure, and (iii) both the upper link and the lower link are integral with, or rigidly connected to, the upper part and the lower part, respectively, of the support structure.

20. The garment steamer according to claim 18, wherein a spring housing is secured inside the upper link, the plunger extends through the spring housing, and a spring is housed in the spring housing and arranged between an inner face of the spring housing and a shoulder on the plunger in order to exert a spring force on the plunger.

* * * * *